US009382920B2

(12) United States Patent
Vogel et al.

(10) Patent No.: US 9,382,920 B2
(45) Date of Patent: Jul. 5, 2016

(54) WET GAS COMPRESSION SYSTEMS WITH A THERMOACOUSTIC RESONATOR

(75) Inventors: Christian Vogel, Bayern (DE); Vittorio Michelassi, Bayern (DE); Rene de Nazelle, Bayern (DE)

(73) Assignee: General Electric Company, Niskayuna, NY (US)

( * ) Notice: Subject to any disclaimer, the term of this patent is extended or adjusted under 35 U.S.C. 154(b) by 749 days.

(21) Appl. No.: 13/295,208

(22) Filed: Nov. 14, 2011

(65) Prior Publication Data

US 2013/0121812 A1 May 16, 2013

(51) Int. Cl.
*F01D 25/10* (2006.01)
*F04D 31/00* (2006.01)
*F17D 1/16* (2006.01)

(52) U.S. Cl.
CPC ..... *F04D 31/00* (2013.01); *Y10T 137/0391* (2015.04)

(58) Field of Classification Search
CPC ..... F04D 31/00; F04D 7/045; B05B 17/06; B05B 17/0623; F05B 2210/13; F05B 2260/64; F05D 2210/13; F05D 2260/608; F05D 2260/964
USPC ..... 415/169.1–169.2, 175–181
See application file for complete search history.

(56) References Cited

U.S. PATENT DOCUMENTS 3,923,415 A * 12/1975 Benedict ..... 415/1
3,966,120 A 6/1976 Furgalus et al.
4,205,966 A 6/1980 Horikawa
4,398,925 A 8/1983 Trinh et al.
5,369,625 A * 11/1994 Gabrielson ..... 367/140
6,230,420 B1 5/2001 Lawrenson et al.
6,273,674 B1 * 8/2001 Charron ..... 415/169.3
7,143,586 B2 12/2006 Smith et al.
2005/0220711 A1 10/2005 Katz
2006/0130506 A1 6/2006 Tain et al.
2008/0053097 A1 3/2008 Han et al.
2009/0282838 A1 11/2009 Thurnau
2010/0054503 A1 * 3/2010 Jiang et al. ..... 381/164
2010/0212311 A1 * 8/2010 McQuary et al. ..... 60/520
2010/0236724 A1 * 9/2010 Duesel et al. ..... 159/4.02

FOREIGN PATENT DOCUMENTS

CN 1392380 A 1/2003
CN 101054960 A 10/2007
CN 101619713 A 1/2010
CN 101751916 A 6/2010
CN 201935319 U 8/2011
EP 1529927 A2 5/2005

(Continued)

OTHER PUBLICATIONS

U.S. Appl. No. 13/020,873, filed Feb. 4, 2011, Aalburg.

(Continued)

*Primary Examiner* — Craig Kim
*Assistant Examiner* — Alexander White
(74) *Attorney, Agent, or Firm* — Andrew J. Caruso

(57) ABSTRACT

The present application provides a wet gas compression system for a wet gas flow having a number of liquid droplets therein. The wet gas compression system may include a pipe, a compressor in communication with the pipe, and a thermoacoustic resonator in communication with the pipe so as to break up the liquid droplets in the wet gas flow.

20 Claims, 4 Drawing Sheets

(56) References Cited

FOREIGN PATENT DOCUMENTS

| | | | |
|---|---|---|---|
| WO | 2010062252 | A1 | 6/2010 |
| WO | 2011081528 | A1 | 7/2011 |

OTHER PUBLICATIONS

Search Report and Written Opinion from corresponding PCT Application No. PCT/US2012/064490 dated Feb. 14, 2013.

Hiller et al., "Condensation in a Steady-Flow Thermoacoustic Refrigerator", Journal of the Acoustical Society of America, vol. No. 108, Issue No. 4, pp. 1521-1527, 2000.

Zeoli et al., "Numerical Modelling of Droplet Break-up for Gas Atomisation", Computational Materials Science, vol. No. 38, Issue No. 2, pp. 282-292, Dec. 2006.

Kuan, "CFD Modelling of Liquid Jet and Cascade Breakup in Crossflows", 7th International Conference on CFD in the Minerals and Process Industries, Melbourne, Australia, pp. 6, Dec. 9-11, 2009.

Chinese Office Action issued in connection with corresponding CN Application No. 201280055785.1 on Oct. 20, 2015.

* cited by examiner

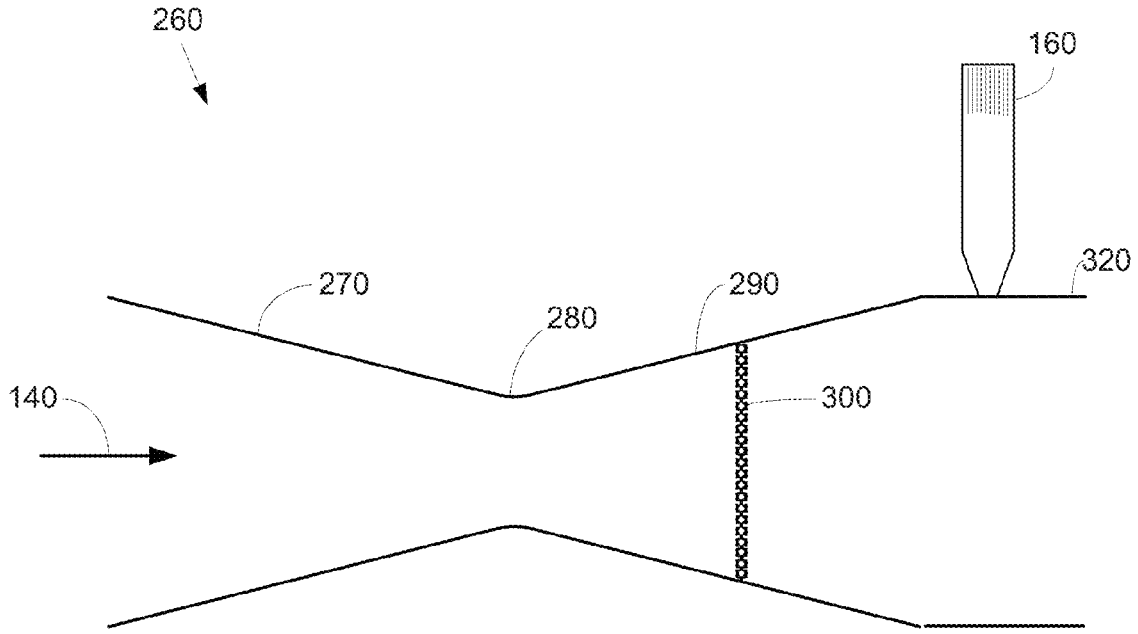
Fig. 6
Fig. 7
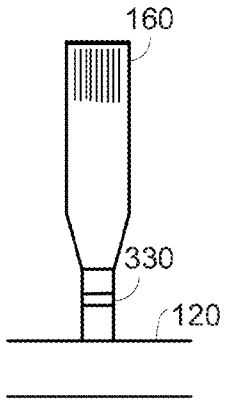

WET GAS COMPRESSION SYSTEMS WITH A THERMOACOUSTIC RESONATOR

TECHNICAL FIELD

The present application and the resultant patent relate generally to wet gas compression systems and more particularly relate to a wet gas compression system using a thermoacoustic resonator to break up water droplets in a gas stream before reaching a compressor.

BACKGROUND OF THE INVENTION

Natural gas and other types of fuels may include a liquid component therein. Such "wet" gases may have a significant liquid volume. In conventional compressors, liquid droplets in such wet gases may cause erosion or embrittlement of the impellers or other components. Moreover, rotor unbalance may result from such erosion. Specifically, the negative interaction between the liquid droplets and the compressor surfaces, such as the impellers, end walls, seals, and the like, may be significant. Erosion is known to be a function essentially of a combination of the relative velocity of the droplets during impact, droplet mass size, and impact angle. Erosion may lead to performance degradation, reduced compressor and component lifetime, and an overall increase in maintenance requirements.

Current wet gas compressors may use an upstream liquid-gas separator to separate the liquid droplets from the gas stream so as to limit or at least localize the impact of erosion and other damage caused by the liquid droplets. The equipment required for separation, however, generally requires additional power consumption. Another approach is to use a convergent-divergent nozzle such as a de Laval nozzle and the like so as to accelerate the gas flow to a supersonic velocity. The resulting supersonic shock may break up the liquid droplets. The supersonic shock, however, also may lead to a pressure drop upstream of the compressor and therefore an increase in overall compressor duty.

There is thus a desire for improved wet gas compression systems and methods of avoiding erosion. Preferably, such systems and methods may minimize the impact of erosion and other damage caused by large liquid droplets in a wet gas flow while avoiding or at least reducing the need for liquid-gas separators, supersonic shocks, and the like.

SUMMARY OF THE INVENTION

The present application and the resultant patent thus provide a wet gas compression system for a wet gas flow having a number of liquid droplets therein. The wet gas compression system may include a pipe, a compressor in communication with the pipe, and a thermoacoustic resonator in communication with the pipe so as to break up the liquid droplets in the wet gas flow.

The present application and the resultant patent further provide a method of breaking up a number of large liquid droplets in a wet gas flow upstream of a compressor. The method may include the steps of flowing the wet gas flow through a pipe, creating a number of acoustic waves about the wet gas flow with a thermoacoustic resonator, reducing a relative velocity of a gaseous phase to a liquid phase of the wet gas flow, and overcoming a surface tension of the number of large liquid droplets to break the large liquid droplets into a number of small liquid droplets. Other methods also may be described herein.

The present application and the resultant patent further provide a wet gas compression system for a wet gas flow having a number of liquid droplets therein. The wet gas compression system may include a pipe, a compressor in communication with the pipe, and a thermoacoustic resonator in communication with the pipe and positioned upstream of the compressor. The thermoacoustic resonator may include a hot heat exchanger, a cold heat exchanger, and a regenerator therebetween so as to produce a number of acoustic waves into the wet gas flow. Other systems also may be described herein.

These and other features and improvements of the present application and the resultant patent will become apparent to one of ordinary skill in the art upon review of the following detailed description when taken in conjunction with the several drawings and the appended claims.

BRIEF DESCRIPTION OF THE DRAWINGS

FIG. 6 is a partial side view of an example of an alternative embodiment of a wet gas compression system with a thermoacoustic resonator as may be described herein.

FIG. 7 is a partial side view of an example of an alternative embodiment of a wet gas compression system with a thermoacoustic resonator as may be described herein.

DETAILED DESCRIPTION

Figure 1:
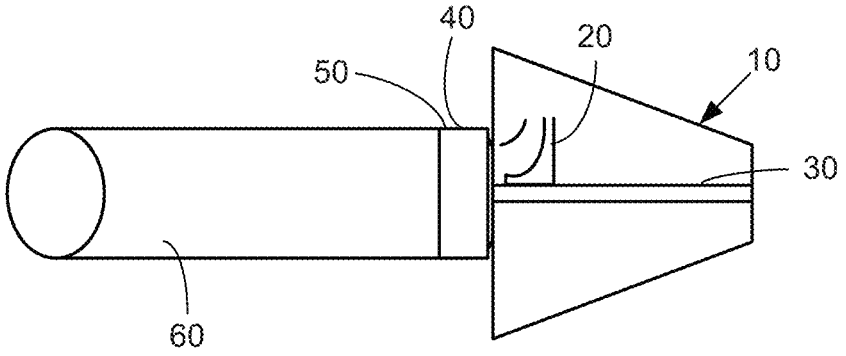
FIG. 1 is a schematic diagram of a known wet gas compressor with a portion of a pipe section.

Referring now to the drawings, in which like numerals refer to like elements throughout the several views, FIG. 1 shows an example of a known wet gas compressor 10. The wet gas compressor 10 may be of conventional design and may include a number of stages with a number of impellers 20 positioned on a shaft 30 for rotation therewith among a number of stators. The wet gas compressor 10 also may include an inlet section 40. The inlet section 40 may be an inlet scroll 50 and the like positioned about the impellers 20. Other types and configurations of wet gas compressors 10 may be known. A pipe section 60 may be in communication with the inlet section 40 of the wet gas compressor 10. The pipe section 60 may be of any desired size, shape, or length. Any number of pipe sections 60 may be used herein and may be joined in a conventional manner.

Figure 2:
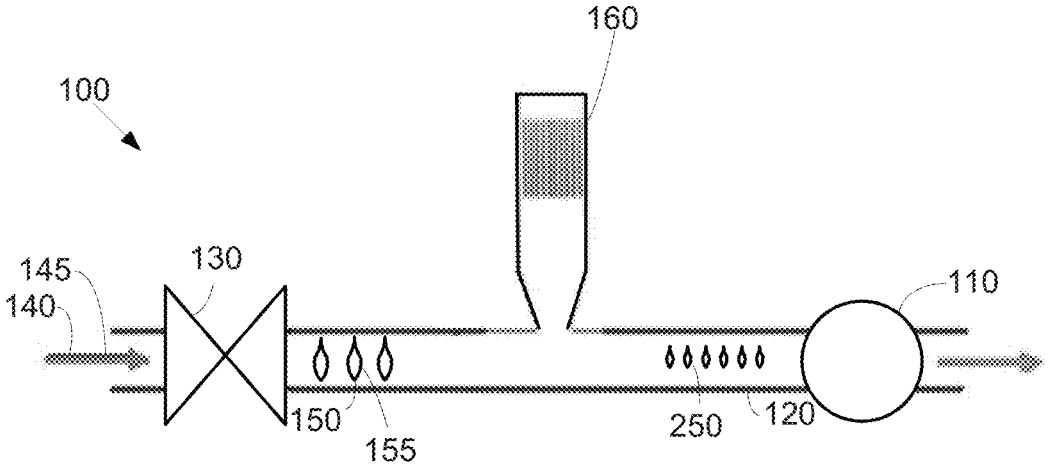
FIG. 2 is a schematic diagram of an example of a wet gas compression system as may be described herein with a thermoacoustic resonator.
Figure 3:
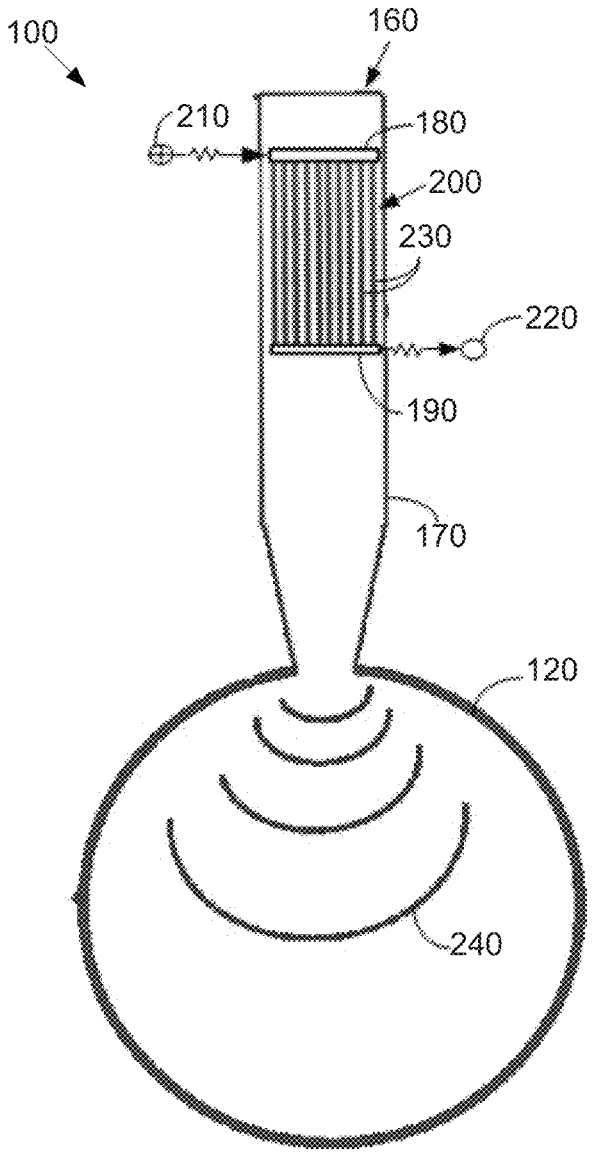
FIG. 3 is a schematic diagram of the thermoacoustic resonator of the wet gas compression system of FIG. 2.

FIG. 2 shows an example of a wet gas compression system 100 as may be described herein. The wet gas compression system 100 may include a compressor 110 positioned about a pipe 120. The compressor 110 may be similar to the compressor 10 described above. Any type or number of compressors 110 may be used herein. Likewise, the pipe 120 may have any size, shape, length, or any number of sections. The pipe 120 may be in communication with a well head 130. A wet gas flow 140 comes out of the well head 130 and flows through the compressor 110 and then further downstream. The wet gas flow 140 may include gaseous phase 145 as well as a number of large liquid droplets 150 in a liquid phase 155. The wet gas flow 140 may be a natural gas, other types of fuels, and the like. Other components and other configurations also may be used herein.

The wet gas compression system 100 also may include a thermoacoustic resonator 160. Generally described, the thermoacoustic resonator 160 uses an internal temperature differential to induce high amplitude acoustic waves in an efficient manner. The thermoacoustic resonator 160 may be coupled to the pipe 120 downstream of the well head 130 and upstream of the compressor 110. Any number of thermoacoustic resonators 160 may be used herein.

The thermoacoustic resonator 160 may include acoustic chamber 170. The acoustic chamber 170 may be in direct communication with the pipe 120 such that the wet gas flow 140 floods the acoustic chamber 170. Subject to the fact that the configuration of the acoustic chamber 170 may have an impact on the nature and the wavelength of the acoustic waves produced therein, the acoustic chamber 170 may have any size, shape, or configuration.

The thermoacoustic resonator 160 may include a hot heat exchanger 180, a cold heat exchanger 190, and a passive heat regenerator 200 positioned therebetween. At the hot heat exchanger 180, a heat source 210 rejects heat to the wet gas flow 140 thereabout. The heat source 210 may include any type of heat and any type of heat source. For example, waste heat from the compressor 110 or elsewhere may be used. At the cold heat exchanger 190, heat may be accepted from the wet gas 140 and transferred to a cooling stream or a heat sink 220 for disposal or use elsewhere. The passive heat regenerator 200 may include a stack of plates 230 and the like. Any type of regenerator with good thermal efficiency may be used herein.

The temperature gradient between the hot heat exchanger 180 and the cold heat exchanger 190 across the passive heat exchanger 200 of the thermoacoustic resonator may lead to the formation of a number of acoustic waves 240. The acoustic waves 240 act as pressure waves that propagate through the acoustic chamber 170 and into the pipe 120. The wavelengths and other characteristics of the acoustic waves 240 may be varied herein. Other types of thermoacoustic resonators and other means for producing the acoustic waves 240 also may be used herein. Other components and other configurations also may be used herein.

Figure 4:
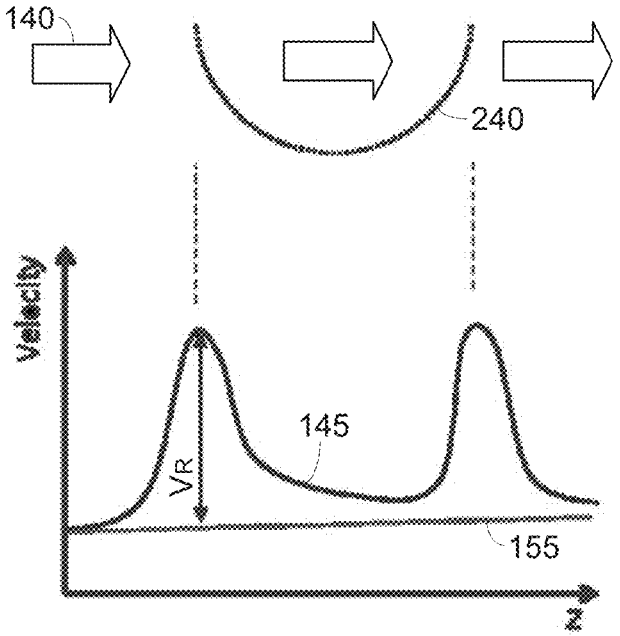
FIG. 4 is a chart showing the relative velocity of the liquid and the gaseous phases of the wet gas flow about the thermoacoustic resonator of the wet gas compression system of FIG. 2.

As is shown in FIG. 4, the pressure front caused by the acoustic waves 240 interacts with the wet gas flow 140 in the pipe 120. The interaction of the acoustic waves 240 may cause a rapid velocity change in the gaseous phase 145 of the wet gas flow 140. The change in the relative velocity between the gaseous phase 145 and the liquid phase 155 of the wet gas flow 140 thus may break up the large liquid droplets 150 into a number of smaller liquid droplets 250 as the wet gas flow 140 passes through the acoustic waves 240.

Droplet break up may be largely a function of the relative velocity between the gaseous phase 145 and the liquid phase 155. The potential for droplet break up may be evaluated based upon the Weber number of the wet gas flow 140. Specifically, the Weber number may be calculated in the context of the wet gas flow 140 herein as follows:

$$\text{Weber}=P_g V_R^2 d/\sigma.$$

In this equation, $P_g$ is the density of the fluid (kg/m$^3$), $V_R$ is the relative velocity (m/s), d is the droplet diameter (in), and $\sigma$ is the surface tension (n/m). Generally described, the Weber number is a non-dimensional measure of the relative importance of the inertia of the fluid as compared to the droplet surface tension. The large liquid droplets 150 thus may be broken down into the smaller liquid droplets 250 if the Weber number indicates that the kinetic energy of the gaseous phase 145 may overcome the surface tension of the droplets 150. Other types of droplet evaluation and other types of protocols may be used herein.

The energy of the acoustic waves 240 may be partially transferred into droplet break up and partially transferred into dissipation in the wet gas flow 140. Dissipation means a deposition of heat into the wet gas flow 140. This heat leads largely to liquid evaporation as opposed to a temperature increase and therefore may be beneficial to overall compressor performance. After passing through the acoustic waves 240, the wet gas flow 140 continues towards the compressor inlet section 40 with the smaller liquid droplets 250 therein so as to reduce harmful erosion on the impellers 20 and the like.

The wet gas compression system 100 with the thermoacoustic resonator 160 thus should improve overall lifetime and efficiency of the compressor 110. Specifically, removal of the large liquid droplets 150 may improve erosion damage while higher compressor efficiency may be achieved due to evaporation. Moreover, because the thermoacoustic resonator 160 uses no moving parts, the thermoacoustic resonator 160 should have a long lifetime with low maintenance requirements. Further, because the thermoacoustic resonator 160 may use waste heat from the compressor 110 or elsewhere, the thermoacoustic resonator 160 may not result in parasitic energy loses. The thermoacoustic resonator 160 also may avoid a pressure drop therethrough such that the main compressor duty may not be increased.

Figure 5:
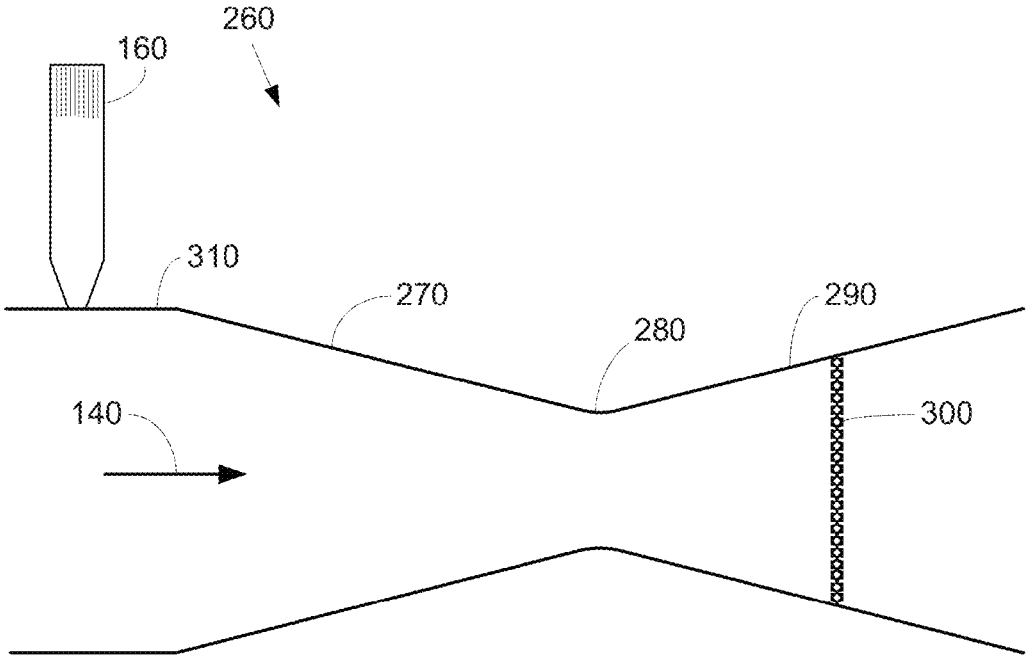
FIG. 5 is a partial side view of an example of an alternative embodiment of a wet gas compression system with a thermoacoustic resonator as may be described herein.

Although the wet gas compression system 100 described above has been discussed in the context of the thermoacoustic resonator 160 positioned about the pipe 120, the thermoacoustic resonator 160 also may be positioned elsewhere. For example, FIG. 5 and FIG. 6 show the use of the thermoacoustic resonator 160 about a convergent-divergent nozzle 260 or other type of variable cross-section nozzle. As described above, the convergent-divergent nozzle 260, also is known as a de Laval nozzle and the like, may include a convergent section 270, a throat section 280, and a divergent section 290. The convergent-divergent nozzle 260 may reduce the large liquid droplets 150 via a supersonic shock at a shock point 300.

In the example of FIG. 5, the thermoacoustic resonator 160 may be positioned on an upstream section of pipe 310. In the example of FIG. 6, the thermoacoustic resonator 160 may be positioned on a downstream section of pipe 320. The thermoacoustic resonator 160 may be positioned anywhere about or along the convergent-divergent nozzle 260 so as to assist and promote droplet break up in a manner similar to that described above. Multiple thermo acoustic resonators 160 may be used herein. Other type of pipes and other types of nozzles may be used herein. Other components and other configurations also may be used herein.

As an alternative to the thermoacoustic resonator 160 being in direct fluid communication with the wet gas flow 140 within the pipe 120, the thermoacoustic resonator 160 also may be physically separated from the wet gas flow 140 in the pipe 120. As is shown in FIG. 7, the thermoacoustic resonator 160 may be connected to the pipe 120 via a moving piston 330 and the like. The acoustic waves 240 may drive the moving piston 330 into contact with the pipe 120 such that the waves continue therein via the mechanical contact. The use of the piston 330 also allows the use of a different working medium within the thermoacoustic resonator 160. Mediums such as helium, nitrogen, or other gases may be used. The use of an alternative medium may be beneficial from an efficiency and stability point of view, i.e., increased efficiency in the conversion of heat to acoustic energy. Other types of mechanical systems also may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A wet gas compression system for a wet gas flow having a number of liquid droplets therein, the wet gas compression system comprising:

a pipe for channeling the wet gas flow;

a compressor comprising a plurality of impellers and an inlet section, wherein the inlet section is in communication with the pipe; and a thermoacoustic resonator in communication with the pipe, wherein the thermoacoustic resonator: receives heat from the compressor; and induces acoustic waves in the pipe using the received heat to break up liquid droplets in the wet gas flow before the inlet section of the compressor receives the wet gas flow.

2. The wet gas compression system of claim 1, wherein the thermoacoustic resonator comprises an acoustic chamber positioned on the pipe and in communication with the wet gas flow.

3. The wet gas compression system of claim 2, wherein the acoustic chamber is configured to:

receive the heat from the compressor and transfer the heat to the wet gas flow at a first end of the acoustic chamber;

receive the heat from the wet gas flow and transfer the heat to a heat sink at a second end of the acoustic chamber; and create a temperature gradient between the first end and the second end of the acoustic chamber to induce the acoustic waves in the acoustic chamber.

4. The wet gas compression system of claim 1, wherein the thermoacoustic resonator comprises a hot heat exchanger, a cold heat exchanger, and a regenerator therebetween.

5. The wet gas compression system of claim 4, wherein the hot heat exchanger is in communication with a heat source and wherein the heat source comprises the compressor configured to provide the heat to the hot heat exchanger.

6. The wet gas compression system of claim 4, wherein the cold heat exchanger is in communication with a heat sink configured to accept the heat from the cold heat exchanger.

7. The wet gas compression system of claim 4, wherein the regenerator comprises a passive heat regenerator, wherein the acoustic waves are induced due to a temperature gradient between the hot heat exchanger and the cold heat exchanger across the passive heat regenerator.

8. The wet gas compression system of claim 4, wherein the regenerator comprises a plurality of plates.

9. The wet gas compression system of claim 1, wherein the plurality of acoustic waves breaks up a number of large liquid droplets to a number of small liquid droplets.

10. The wet gas compression system of claim 1, wherein the pipe comprises a convergent divergent nozzle.

11. The wet gas compression system of claim 10, wherein the convergent divergent nozzle comprises a convergent section, a throat section, a divergent section, and a shock point.

12. The wet gas compression system of claim 1, wherein the thermoacoustic resonator comprises a piston coupled to the pipe, wherein the induced acoustic waves drive the piston to contact the pipe so that the acoustic waves propagate to the pipe through the piston.

13. The wet gas compression system of claim 1, wherein the wet gas flow comprises a flow of natural gas.

14. A method of breaking up a number of large liquid droplets in a wet gas flow upstream of a compressor, comprising:

flowing the wet gas flow through a pipe;

receiving heat from the compressor and inducing a plurality of acoustic waves about the wet gas flow using the received heat, with a thermoacoustic resonator;

reducing a relative velocity of a gaseous phase to a liquid phase of the wet gas flow; and overcoming a surface tension of the number of large liquid droplets to break the number of large liquid droplets into a number of small liquid droplets before providing the wet gas flow to a compressor.

15. The method of claim 14, further comprising transferring the heat from the compressor to the wet gas flow at a first end of the thermoacoustic resonator and from the wet gas flow to a heat sink at a second end of the thermoacoustic resonator.

16. A wet gas compression system for a wet gas flow having a number of liquid droplets therein, the wet gas compression system comprising:

a pipe for channeling the wet gas flow;

a compressor comprising a plurality of impellers and an inlet section, wherein the inlet section is in communication with the pipe; and a thermoacoustic resonator in communication with the pipe and positioned upstream of the compressor;

wherein the thermoacoustic resonator receives heat from the compressor, and wherein the thermoacoustic resonator comprises a hot heat exchanger, a cold heat exchanger, and a regenerator therebetween to produce a plurality of acoustic waves into the wet gas flow using the received heat so as to break up liquid droplets in the wet gas flow before the inlet section of the compressor receives the wet gas flow.

17. The wet gas compression system of claim 16, wherein the thermoacoustic resonator comprises an acoustic chamber positioned on the pipe and in communication with the wet gas flow.

18. The wet gas compression system of claim 16, wherein the hot heat exchanger is in communication with a heat source and wherein the heat source comprises the compressor configured to provide the heat to the hot heat exchanger.

19. The wet gas compression system of claim 16, wherein the cold heat exchanger is in communication with a heat sink configured to accept the heat from the cold heat exchanger.

20. The wet gas compression system of claim 16, wherein the regenerator comprises a passive heat regenerator with a plurality of plates, wherein the acoustic waves are induced due to a temperature gradient between the hot heat exchanger and the cold heat exchanger across the passive heat regenerator.

* * * * *